US009186767B2

(12) United States Patent
Persson

(10) Patent No.: US 9,186,767 B2
(45) Date of Patent: Nov. 17, 2015

(54) KNIFE JIG ASSEMBLY

(71) Applicant: Tormek AB, Lindesberg (SE)

(72) Inventor: Hakan Persson, Lindesberg (SE)

(73) Assignee: Tormek AB, Lindesberg (SE)

( * ) Notice: Subject to any disclaimer, the term of this patent is extended or adjusted under 35 U.S.C. 154(b) by 45 days.

(21) Appl. No.: 13/843,516

(22) Filed: Mar. 15, 2013

(65) Prior Publication Data

US 2013/0295825 A1 Nov. 7, 2013

(30) Foreign Application Priority Data

May 3, 2012 (SE) ..... 1250445

(51) Int. Cl.

| | |
|---|---|
| ***B24B 27/00*** | (2006.01) |
| ***B24B 3/36*** | (2006.01) |
| ***B24B 27/02*** | (2006.01) |
| ***B24B 41/06*** | (2012.01) |
| ***B24B 3/54*** | (2006.01) |

(52) U.S. Cl.

CPC ... *B24B 3/36* (2013.01); *B24B 3/54* (2013.01); *B24B 27/02* (2013.01); *B24B 41/066* (2013.01)

(58) Field of Classification Search

CPC ..... B24B 3/54; B24B 3/543; B24B 27/62; B24B 41/66

USPC ..... 451/45, 367, 370, 371

See application file for complete search history.

(56) References Cited

U.S. PATENT DOCUMENTS

| | | | | |
|---|---|---|---|---|
| 1,907,275 | A * | 5/1933 | Wilson | 451/370 |
| 2,155,175 | A * | 4/1939 | Veron | 451/370 |
| 2,180,230 | A * | 11/1939 | Freeth | 76/82.2 |
| 2,354,607 | A * | 7/1944 | O'Neil | 30/284 |
| 2,658,466 | A * | 11/1953 | Hall | 451/190 |
| 3,032,934 | A * | 5/1962 | Johnsa | 451/45 |
| 3,800,632 | A * | 4/1974 | Juranitch | 451/371 |
| 4,216,627 | A * | 8/1980 | Westrom | 451/175 |
| 5,191,737 | A | 3/1993 | Snoddy | |
| 5,571,956 | A * | 11/1996 | Sargent | 73/104 |
| 5,667,427 | A * | 9/1997 | Airhart et al. | 451/45 |
| 7,959,494 | B1 * | 6/2011 | Pietrzak | 451/45 |

FOREIGN PATENT DOCUMENTS

| | | |
|---|---|---|
| EP | 0 214 943 | 3/1987 |
| EP | 1 987 916 | 11/2008 |
| WO | WO 97/33717 | 9/1997 |
| WO | WO 2007/098470 | 8/2007 |
| WO | WO 2007/113510 | 11/2007 |

OTHER PUBLICATIONS

European Search Report for EP Application No. 13 15 6747 mailed Oct. 27, 2014 (4 pages).

* cited by examiner

*Primary Examiner* — Maurina Rachuba

(74) *Attorney, Agent, or Firm* — Merchant & Gould P.C.

(57) ABSTRACT

A knife jig assembly (1, 3) for use in sharpening a knife (8) in a grinding machine (16) comprises a conventional knife jig (1) with a clamp (2) for clamping and holding an object. It also comprises a knife holder (3) with means (5, 10) for holding the knife (8) and with a flat rod (4) to be clamped by the clamp (2) of the knife jig (1).

13 Claims, 2 Drawing Sheets

KNIFE JIG ASSEMBLY

This application claims benefit of Serial No. 1250445-2, filed 3 May 2012 in Sweden and which application is incorporated herein by reference. To the extent appropriate, a claim of priority is made to the above disclosed application.

TECHNICAL FIELD

The present invention relates to a knife jig assembly for use in sharpening a knife in a grinding machine, comprising a conventional knife jig with a clamp for clamping and holding an object.

BACKGROUND OF THE INVENTION

The use of a knife jig at the sharpening of a knife in a grinding machine with a rotating grindstone is conventional. The jig has a clamp for holding the knife, and the jig may be manually operated during the sharpening process, preferably supported by a rod-shaped universal support of the grinding machine.

A problem with such a knife jig relates to the dimensions of the knife blade to be held by the clamp. The blade must normally have a length of some 60 mm and width of some 14 mm to be properly held by the clamp and satisfactorily sharpened by the grinding machine.

Small woodcarving knifes are normally very difficult to mount parallelly, so that an equally large grind bevel is obtained at both sides. The reason is that the blade is only parallel over a very small area close to the handle.

The main object of the invention is to increase the versatility of the knife jig, so that it can be used for a broader range of dimensions and shapes of the knives to be sharpened.

The Invention

This object is according to the invention attained by the addition to the knife jig of a knife holder with means for holding the knife and with a flat rod to be clamped by the clamp of the knife jig. The result is a knife jig assembly comprising the conventional knife jig and the inventive knife holder having a flat rod, which can be simply and securely held by the knife jig clamp. The operation of the knife jig assembly at sharpening is very similar to the operation of the knife jig alone.

The means for holding the knife may preferably be two pairs of open jaws attached to the flat rod and a closed-loop yoke between the jaws, the yoke being movable for engaging the knife.

Surfaces of the jaws intended for cooperation with the handle of the knife may preferably be concave in all directions, which means that the knife handle bears against four points of the jaws.

In a threaded hole the yoke may be provided with a screw for engagement with the flat rod.

BRIEF DESCRIPTION OF THE DRAWINGS

The invention will be described in more detail below under reference to the accompanying drawings, in which.

DETAILED DESCRIPTION

Figure 3:
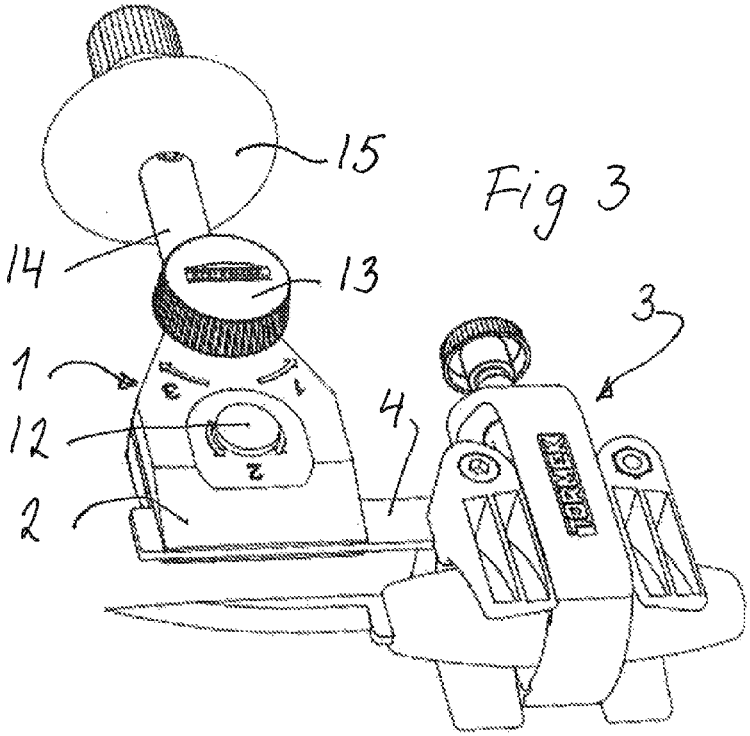
FIG. 3 is an isometric view of the knife holder holding the knife and held by a knife jig.
Figure 4:
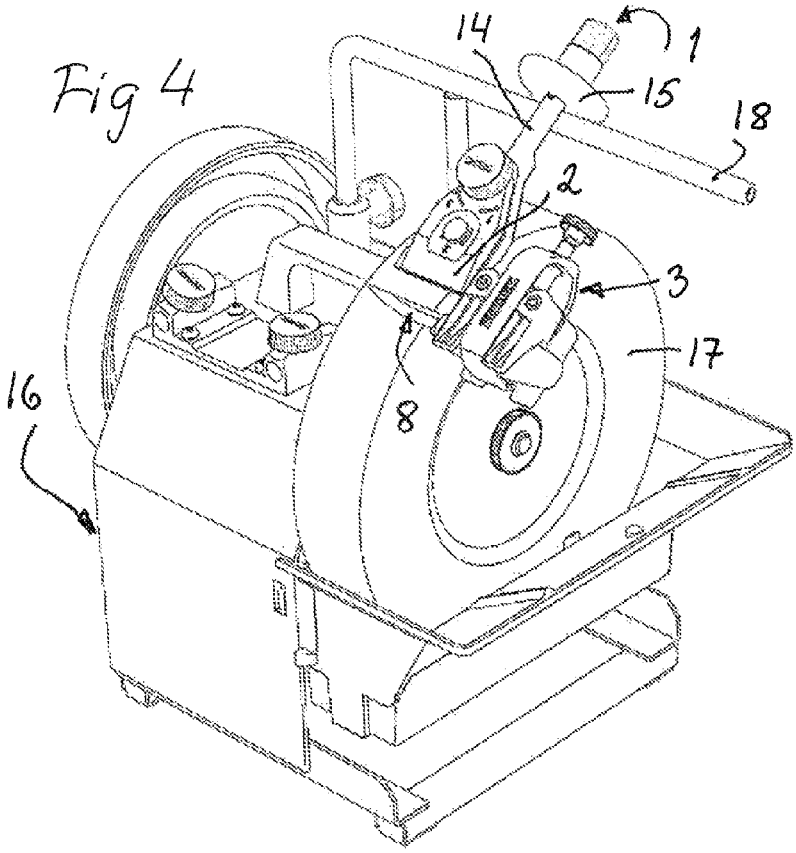
FIG. 4 is an illustration of the sharpening of a knife in a grinding machine by means of a knife jig assembly according to the invention.

A conventional knife jig 1 for knife sharpening is shown in FIGS. 3 and 4. This jig 1 will be described further below. A knife to be sharpened in a conventional grinding machine is to be attached to and held by an adjustable clamp 2 of the jig 1. A problem with this is that the knife has to have a certain width in order to secure a proper holding by the clamp 2.

Figure 1:
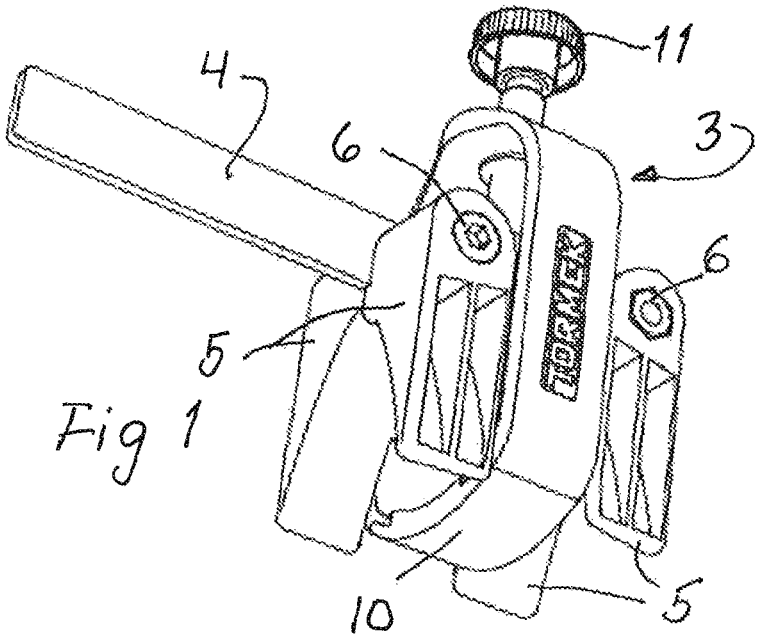
FIG. 1 is an isometric view of a knife holder to be used together with a knife jig to form a knife jig assembly according to the invention.

This problem will effectively be solved by a knife holder 3 to be described, first with reference to FIG. 1.

Figure 2:
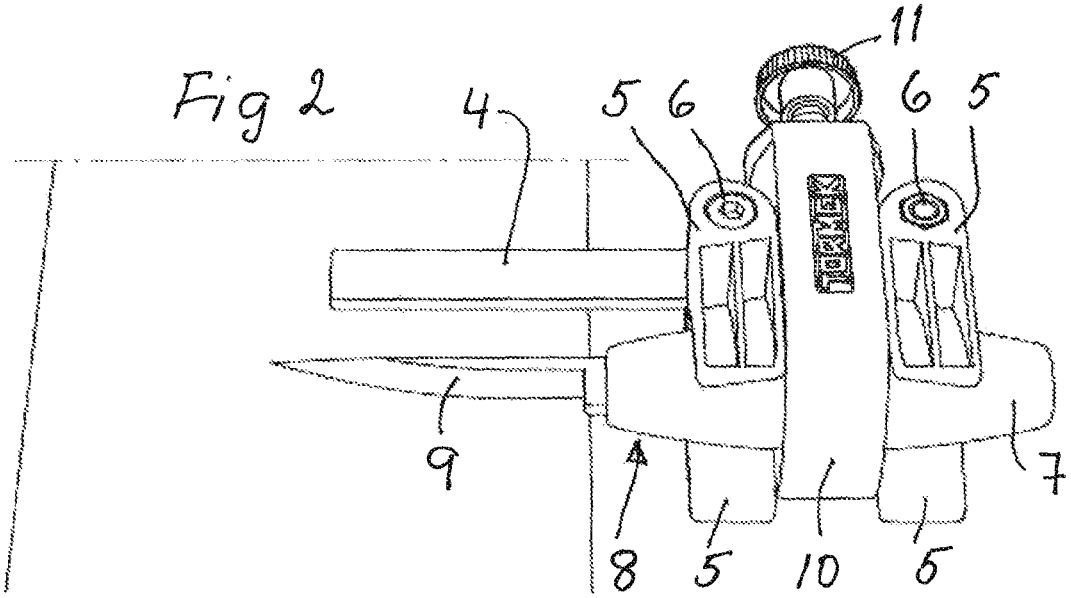
FIG. 2 is an isometric view of the knife holder holding a knife.

The knife holder 3 is built-up around a flat bar 4. Permanently attached perpendicularly to this flat bar 4 are two pairs of jaws 5. The attachment of the jaws 5 to the flat bar 4 can be performed by means of screws 6 in through holes in the flat bar 4. The jaws 5 open out from the flat bar 4, so that a handle 7 of a knife 8 can be placed in the space between and supported by the jaws with its blade 9 pointing in the same direction as the flat bar 4, as is illustrated in FIG. 2. All internal surfaces of the jaws 5 or jaw surfaces intended for cooperation with the knife handle 7 are concave in all directions, so that the knife handle bears against four points of the jaws 5.

A closed-loop yoke 10 is arranged between the two pairs of jaws 5. In its end portion facing away from the jaws 5 it is provided with a threaded hole for a screw 11 engaging the flat bar 4. Its opposite closed end portion is intended for engaging and holding the knife handle 7 against the jaws 5, when the screw 11 is tightened.

The result is a firm attachment and support of a knife handle of any size and shape at at least five points of the jaws 5 and the yoke 10, so that the knife blade 9 can be held in parallel with the flat bar 4. The jaws 5 and the yoke 10 accordingly together constitute means for holding a knife.

As the knife 8 is held by its handle 7, the width of the knife blade 9 is of no significance for the holding.

FIG. 2 illustrates that the knife 8 can be attached to the knife holder 3, while the flat bar 4 is supported on a flat surface, for example a table. In this way the knife blade 9 will be parallel with the flat bar 4.

The knife holder 3 is intended for use with a conventional knife jig 1 in a way illustrated in FIG. 3 and also FIG. 4. This knife jig 1 is provided with an adjustable clamp 2 originally intended for clamping a knife to be sharpened. In its use together with the knife holder 3, however, the flat bar 4 is instead to be clamped and held by the clamp 2.

The knife jig 1 is provided with a screw 12 for adjusting the clamp width to the flat bar 4 and a tightening knob 13 for locking the clamp 2.

The knife jig 1 further has a rod-shaped handle 14 with an adjustable stop 15.

The per se known knife jig 1 has further features, which are not described, because they are of no importance for the understanding of the invention.

The use of the knife jig assembly 1, 3 for sharpening a knife 8 is illustrated in FIG. 4.

The knife 8 is attached in the knife holder 3 as described above with the flat bar 4 as a reference. The knife holder 3 is then attached to the knife jig 1 by its flat bar 4 as described above. In this way it is secured that the knife 8 is properly positioned in the knife jig 1 and is later ground with an equally large grind bevel at both sides.

The knife jig assembly 1, 3 is placed in a conventional grinding machine 16 with a rotating grindstone 17. The grinding machine 16 is provided with a rod-shaped universal support 18, on which the handle 14 of the knife jig 1 is to rest with its stop 15 engaging the universal support 18.

The operation of the knife jig assembly 1, 3 for sharpening the knife 8 by the rotating grindstone 17 is virtually the same as for the conventional knife jig 1 and is accordingly not described in detail.

The tool to be sharpened is throughout the specification called a knife, but other similar edge tools can also be sharpened with the aid of the knife jig assembly according to the invention Modifications are possible within the scope of the appended claims.

The invention claimed is:

1. A knife jig assembly for use in sharpening a knife in a grinding machine, comprising a knife holder comprising a knife holding mechanism constructed for holding a handle of the knife, and a connecting rod comprising a first end and a second end, wherein the second end extends from the knife holding mechanism; and a knife jig comprising a handle connected to a clamp, wherein the clamp is constructed to clamp and hold the second end of the connecting rod.

2. The knife jig assembly of claim 1, wherein the knife holding mechanism comprises jaws attached to the connecting rod and a closed-loop yoke, the yoke being movable relative to the jaws for engaging the knife.

3. The knife jig assembly of claim 2, wherein the jaws comprise inside surfaces adapted for cooperation with the handle of the knife, and wherein the inside surfaces are concave.

4. The knife jig assembly of claim 2, wherein the yoke is movable relative to the connecting rod and wherein the yoke comprises a threaded hole that is provided with a screw for engagement with the connecting rod.

5. The knife jig assembly of claim 2, wherein the jaws and the closed-loop yoke are constructed to position the knife parallel to the connecting rod when the jaws and the closed-loop yoke engage the knife.

6. The knife jig assembly of claim 2, wherein the knife holding mechanism comprises two pairs of jaws.

7. The knife jig assembly of claim 2, wherein the knife holding mechanism comprises two pairs of open jaws.

8. A grinding machine assembly comprising:

a grinding machine for sharpening a knife, the grinding machine comprising a rotatable circular grindstone and a support rod; and a knife jig assembly comprising a knife holder and a knife jig, wherein the knife holder comprises a knife holding mechanism and a connecting rod having a first end and a second end, the second end extending from the knife holding mechanism, and wherein the knife jig comprises a handle connected to a clamp, the handle being constructed to engage with the support rod and the clamp being constructed to clamp and hold the second end of the connecting rod.

9. The grinding machine assembly of claim 8, wherein the knife holding mechanism comprises jaws coupled with the first end of the connecting rod, and a closed-loop yoke, wherein the connecting rod extends through an opening of the closed-loop yoke, wherein the connecting rod has a length defined by the first end and the second end, and wherein the closed-loop yoke is adjustable in a direction perpendicular to the length of the connecting rod.

10. The grinding machine assembly of claim 9, wherein the closed-loop yoke is adjustable by a rotatable screw extending through a threaded hole on the closed-loop yoke.

11. The grinding machine assembly of claim 10, wherein the rotatable screw comprises a first end and a second end, and wherein the first end engages the connecting rod.

12. The grinding machine assembly of claim 10, wherein the knife holder is constructed to hold a handle of an edge tool, the handle comprising a length and a first side extending along the length and a second side extending along the length opposite of the first side, wherein the jaws comprise a concave open side constructed to engage the first side of the handle, and wherein the closed-loop yoke is adapted to engage the second side of the handle.

13. A method for using the grinding machine assembly of claim 12 comprising the steps of:

positioning the handle of the edge tool between the jaws and the closed-loop yoke, parallel to the connecting rod, the edge of the edge tool extending toward the grindstone;

adjusting the closed-loop yoke with the rotatable screw so that the jaws and the closed-loop yoke engage the handle of the edge tool;

positioning the edge of the edge tool against the grindstone; and operating the grindstone to sharpen the edge of the edge tool.

* * * * *